US009337579B2

(12) United States Patent
Zhu et al.

(10) Patent No.: US 9,337,579 B2
(45) Date of Patent: May 10, 2016

(54) CONNECTOR ASSEMBLY HAVING AN IMPROVED LATCH MEMBER

(71) Applicant: HON HAI PRECISION INDUSTRY CO., LTD., New Taipei (TW)

(72) Inventors: Qing-Man Zhu, Kunshan (CN); Zhi-Gang He, Kunshan (CN); Xiao-Feng Li, Kunshan (CN); Wei Yao, Kunshan (CN); Jerry Wu, Irvine, CA (US)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/284,685

(22) Filed: May 22, 2014

(65) Prior Publication Data

US 2014/0349509 A1 Nov. 27, 2014

(30) Foreign Application Priority Data

May 23, 2013 (CN) ..... 2013 2 02828309 U

(51) Int. Cl.
*H01R 13/627* (2006.01)
*H01R 13/633* (2006.01)
*H01R 13/6581* (2011.01)

(52) U.S. Cl.
CPC ..... *H01R 13/6335* (2013.01); *H01R 13/6275* (2013.01); *H01R 13/6581* (2013.01)

(58) Field of Classification Search
CPC ..... H01R 13/6275; H01R 13/6335
USPC ..... 439/350, 271
See application file for complete search history.

(56) References Cited

U.S. PATENT DOCUMENTS 7,445,484 B2 11/2008 Wu
2011/0300735 A1* 12/2011 Wu ..... H01R 13/6275 439/345
2012/0214350 A1* 8/2012 Wu ..... H01R 13/5812 439/676

FOREIGN PATENT DOCUMENTS

CN 202076617 12/2011

* cited by examiner

*Primary Examiner* — Abdullah Riyami
*Assistant Examiner* — Nader J Alhawamdeh
(74) *Attorney, Agent, or Firm* — Ming Chieh Chang; Wei Te Chung

(57) ABSTRACT

A cable connector assembly includes a connector and a cable. The connector includes: a housing including a mating portion and a body portion, a latch mechanism mounted on the housing, and a metal casing enclosing the housing. The body portion includes a receiving slot at a front end thereof and a post projecting upwardly. The latch mechanism includes a latch member received in the receiving slot and a pulling member coupled to the latch member. The latch member includes a locking portion extending beyond the body portion and above the mating portion, a holding portion held on the body portion, and a connecting portion. The connecting portion of the latch member includes a first opening mating with the post. The first opening extends from a middle line of the mating portion sidewardly to both sides of the mating portion.

11 Claims, 7 Drawing Sheets

CONNECTOR ASSEMBLY HAVING AN IMPROVED LATCH MEMBER

BACKGROUND OF THE INVENTION

1. Field of the Invention

The present invention relates to a connector assembly, and more particularly to a connector assembly having a latch mechanism.

2. Description of Related Arts

China Patent No. 202076617, issued on Dec. 14, 2011, discloses a cable assembly comprising a body having a receiving space, two printed circuit boards positioned in the receiving space, a latch member assembled to the body, a pulling member connecting with the latch member for driving the latch member, and a metal casing enclosing the body. The body comprises a recessing slot. A front end of the receiving slot comprises a pair of posts projecting upwardly from a bottom wall of the receiving slot. The latch member has a pair of first openings for mating with the posts and a second opening for mating with the pulling member. The region around the first and second openings may not restore to its original state or even be damaged when a large force is applied to the latch member by the pulling member.

U.S. Pat. No. 7,445,484, issued on Nov. 4, 2008, discloses a plug connector comprising a housing and a latch mechanism assembled to the housing. The housing comprises a recessing slot. The recessing slot comprises a pair of posts projecting upwardly from a bottom wall of the receiving slot. The latch mechanism comprises a latch member and a pulling member. The latch member has a pair of first openings to mate with the posts.

An improved connector assembly is desired to offer advantages over the related art.

SUMMARY OF THE INVENTION

An object of the present invention is to provide a connector assembly having a more stable and durable latch member.

To achieve the above-mentioned object, a cable connector assembly comprises a connector and a cable connected with the connector, the connector comprising: a housing comprising a mating portion and a body portion, the body portion comprising a receiving slot at a front end thereof and a post projecting upwardly from a bottom wall of the receiving slot; a latch mechanism mounted on the housing, the latch mechanism comprising a latch member received in the receiving slot and a pulling member coupled to the latch member and moveable along a horizontal direction, the latch member comprising a locking portion extending beyond the body portion and above the mating portion, a holding portion held on the body portion, and a connecting portion connecting the locking portion and the holding portion, the pulling member being actuatable to release the locking portion from a locking state, the connecting portion of the latch member comprising a first opening mating with the post, the first opening extending from a middle line of the mating portion sidewardly to both sides of the mating portion; and a metal casing enclosing the housing.

According to the present invention, with the first opening extending from a middle line to both sides of the mating portion, an area of the latch member around the first opening is enlarged to obtain a strong latch member.

DETAILED DESCRIPTION OF THE PREFERRED EMBODIMENT

Figure 1:
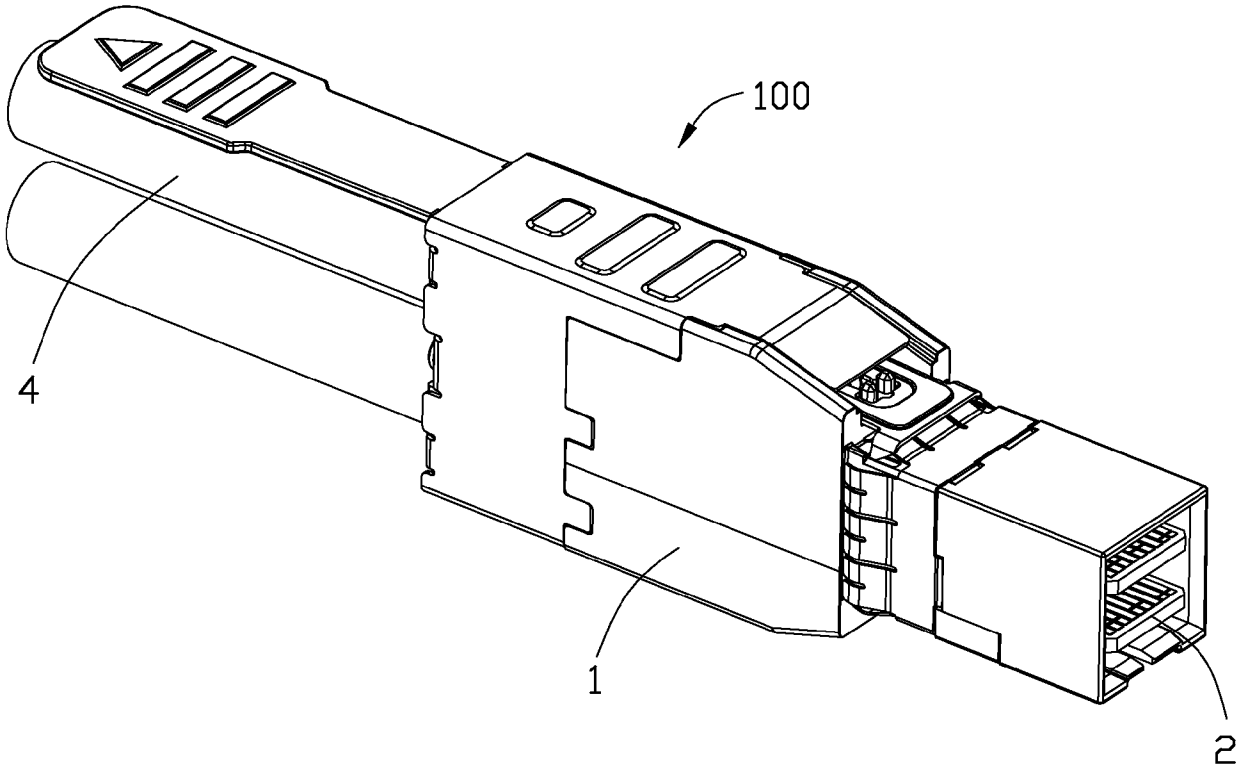
FIG. 1 is a perspective view of a connector in accordance with the present invention.

Reference will now be made in detail to a preferred embodiment of the present invention.

Referring to FIGS. 1 to 6, a cable connector assembly (not labeled) comprises a connector 100 and a cable 4 connected with the connector 100. The connector 100 comprises a housing 1, a pair of printed circuit boards 2 received in the housing 1, a separator 3 disposed between the two printed circuit boards 2, a carrier 5 assembled in the housing 1 to space the two cables 4, an EMI gasket 6 fastened to the housing 1, a latch mechanism 7 mounted on the housing 1, and a metal casing 8 enclosing the housing 1.

The cables 4 connect with the pair of printed circuit boards 2, respectively. In this embodiment, the cable 4 is a copper, and in the other embodiment, the connector can use optic fibers after adding optical-electrical conversion modules.

The housing 1 made of metal material comprises a mating portion 11 sized to fit within a mating connector (not shown) and a body portion 12 sized larger than the mating portion 11. The body portion 12 comprises a receiving slot 123 on a front end of the body portion 12 and an upper wall 122 disposed horizontally behind the receiving slot 123. The receiving slot 123 comprises a bottom wall 1231, a pair of side walls 1232 extending upwardly from the bottom wall 1231 of the receiving slot 123, and a back wall 1233 on the rear of the receiving slot 123. A pair of slots 124 are formed between the back wall 1233 and the pair of side walls 1232. The slots 124 are in communication with the receiving slot 123.

The front end of the receiving slot 123 comprises a post 125 projecting upwardly from the bottom wall 1231 of the receiving slot 123 and a pair of supports 126 extending along the side walls 1232. The pair of supports 126 are symmetrical with each other and a top surface of the supports 126 is curved.

The mating portion 11 of the housing 1 comprises a recessing area 111. The recessing area 111 comprises a pair of recessing grooves 112. The upper wall 122 comprises a lug 127 projecting upwardly. The housing 1 comprises a first housing 13 and a second housing 14 mating with the first housing 13 along a vertical direction. The front end of the first housing 13 is a rectangular opening 131. The rectangular opening 131 is a mating opening. A rear portion of an inner wall of the rectangular opening 131 comprises a pair of retaining slots 132.

The pair of printed circuit boards 2 are disposed apart from each other. Each printed circuit board 2 comprises a first portion 21 disposed at the front of the printed circuit board 2, a second portion 22 disposed at the rear of the printed circuit board 2, and a stepped portion 23 formed between the first portion 21 and the second portion 22. The first portion 21 comprises a plurality of conductive pads 210. The second portion 22 is connected with cable 4. The pair of printed circuit boards 2 are received in the first housing 13. The stepped portion 23 is retained in the retaining slots 132. In this embodiment, there are two printed circuit boards 2, and in other embodiment, the printed circuit board 2 also can be one or more than two.

The separator 3 is made of plastic materials. A pair of side surfaces of the separator 3 comprise a holder block 31 extending along a vertical direction respectively. The holder blocks 31 are mated with the retaining slots 132. An inner portion of the separator 3 comprises a through slot 32 extending along a front-to-back direction. The through slot 32 goes through a front surface and a rear surface of the separator 3. A grounding piece 33 is integrally formed on the separator 3 for reducing electromagnetic interference (EMI). The grounding piece 33 is disposed in the through slot 32 and fixed with the separator 3.

The cable 4 comprises a plurality of core wires 41 electrically connecting with the second portion 22 of the printed circuit boards 2. A metal ring 42 is disposed on a top end of the cable 4 for covering an overlapped portion of the cable 4. A spacer 43 is disposed on the front end of the cable 4 for separating the core wires 41.

Figure 7:
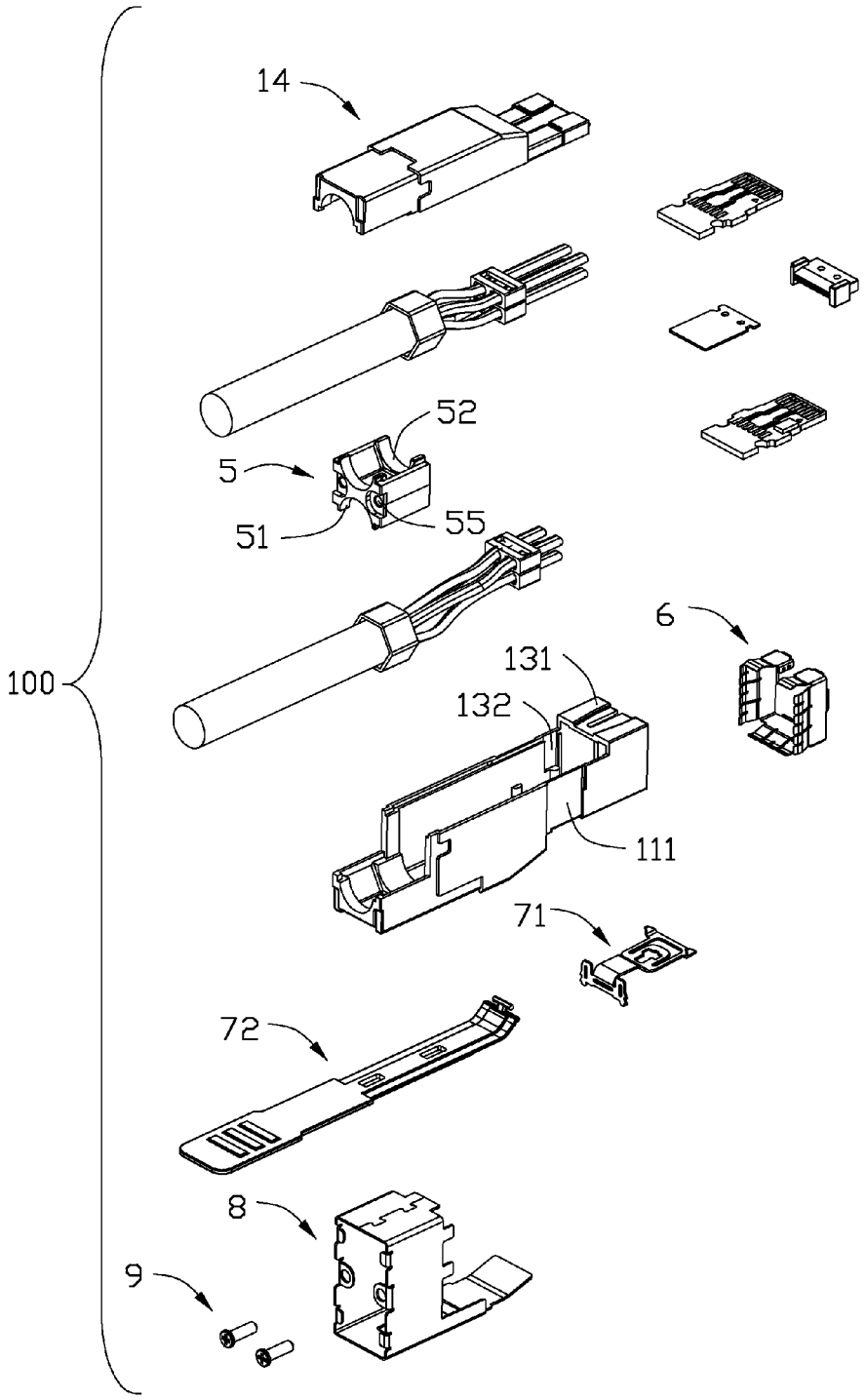
FIG. 7 is another exploded view of the connector assembly as shown in FIG. 1.

Referring to FIG. 7, the carrier 5 disposed in the housing 1 is made of metal materials. The carrier 5 comprises an upper recessing slot 51 on an upper surface and a lower recessing slot 52 on a lower surface of the carrier 5. When the carrier 5 is held between the first housing 13 and the second housing 14, a tail portion of the housing 1, the upper recessing slot 51, and the lower recessing slot 52 cooperate to form two wire holes 53,54. The two wire holes 53,54 are arranged in the vertical direction. A rear portion of the carrier 5 comprises a pair of mounting holes 55.

The EMI gasket 6 is stamped and bent from a metal sheet. The rear end of the EMI gasket 6 comprises a plurality of shrapnels 61. When the first housing 13 is assembled with the second housing 14, the EMI gasket 6 is disposed in the recessing area 111 of the mating portion 11 of the housing 1 to fasten the first housing 13 and the second housing 14.

Figure 4:
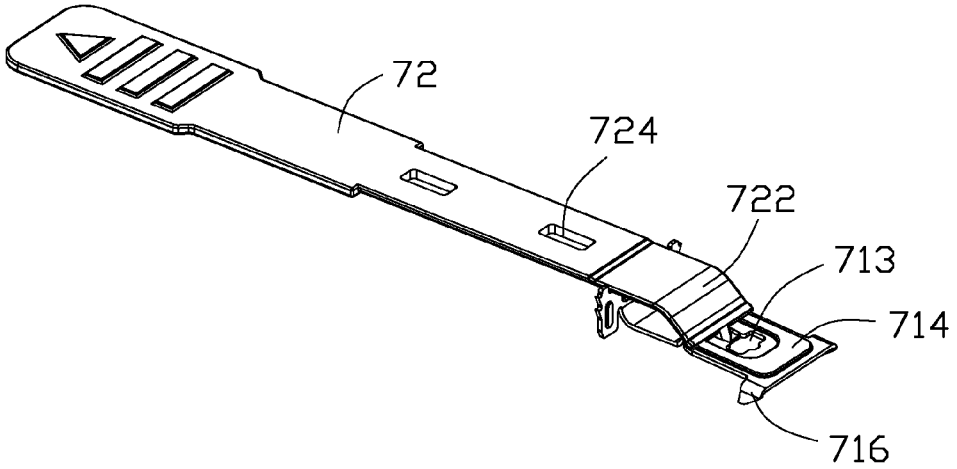
FIG. 4 is a perspective view of the latch mechanism as shown in FIG. 1.
Figure 5:
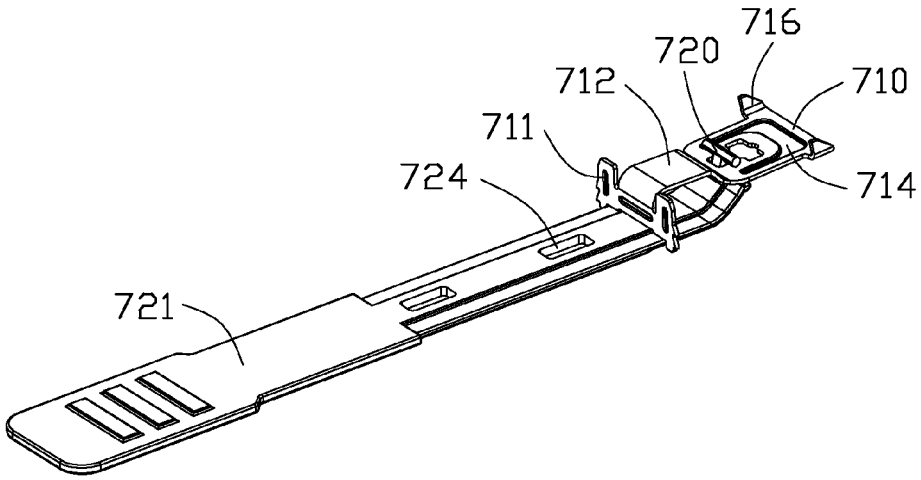
FIG. 5 is another perspective view of the latch mechanism as shown in FIG. 1.
Figure 6:
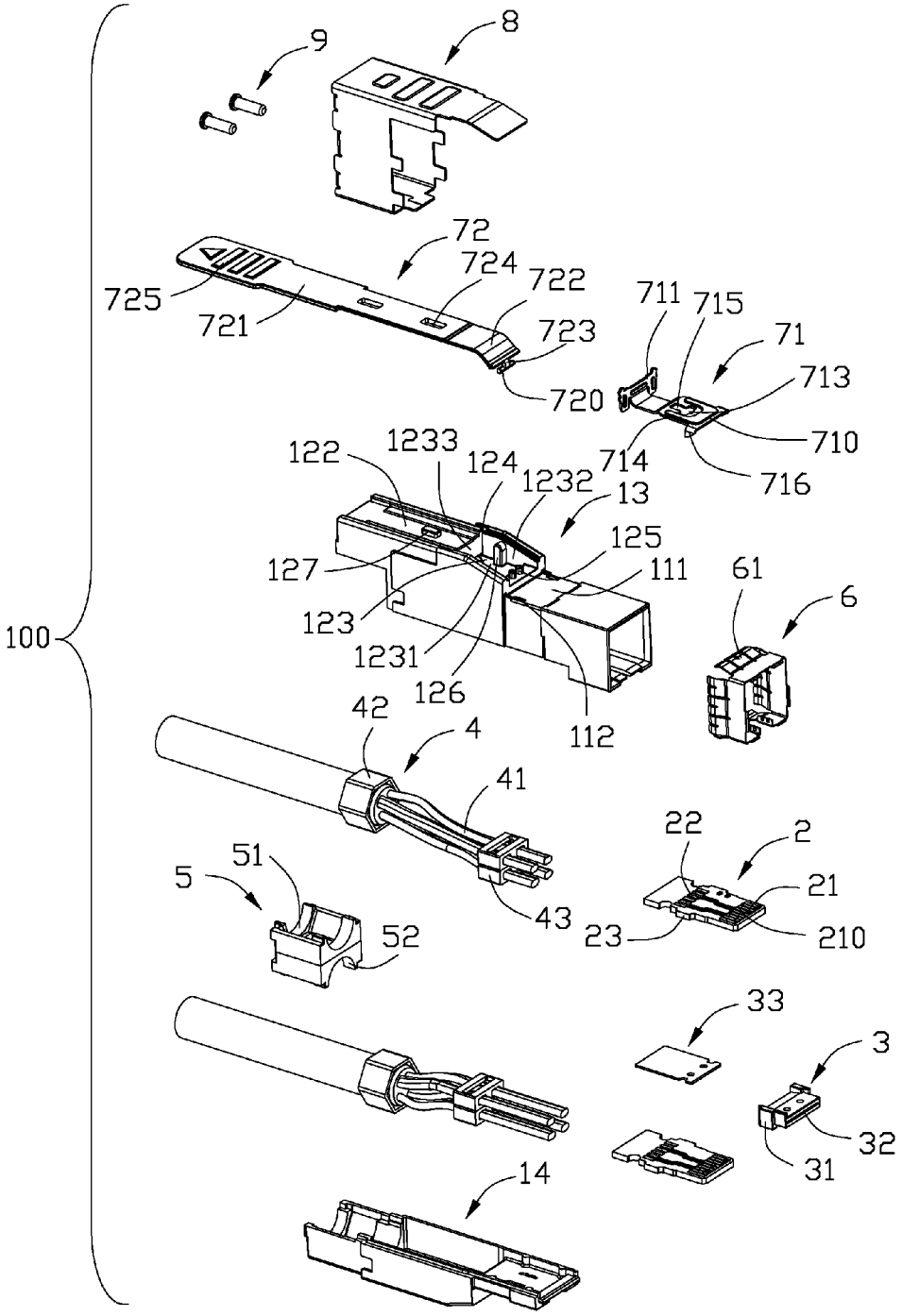
FIG. 6 is an exploded view of the connector assembly as shown in FIG. 1.

Referring to FIGS. 4 to 6, the latch mechanism 7 comprises a latch member 71 received in the receiving slot 123, and a pulling member 72 coupled to the latch member 71 and moveable along a horizontal direction. The latch member 71 is stamped and bent from metal materials and comprises a locking portion 710 extending beyond the body portion 12 and above the mating portion 11, a holding portion 711 held on the body portion 12, and a connecting portion 712 connecting the locking portion 710 and the holding portion 711. The locking portion 710 and the holding portion 711 are set in a horizontal direction and the connecting portion 712 is set in a vertical direction. The pulling member 72 can be actuated to release the locking portion 711 from a locking state. The connecting portion 712 of the latch member 71 comprises a first opening 713 mating with the post 125. The first opening 713 extends from a middle line of the mating portion 11 sidewardly to both sides of the mating portion 11.

The connecting portion 712 of the latch member 71 comprises a projection or rib structure 714. The projection 714 extends from the locking portion 710 along the two sides of the connecting portion 712 toward the holding portion 711. Therefore, when the latch member 71 is disposed on the post 125 by the first opening 713, the region or area of the latch member 71 is enlarged. Therefore, the latch member 71 is easy to return to its original state after unlocking. In this embodiment, the projection 714 is formed by extending upwardly. And in the other embodiment, the projection 714 also can be formed by recessing downwardly from a surface of the locking portion 710.

The connecting portion 712 of the latch member 71 comprises a second opening 715 extending along a front-to-back direction for limiting the driving range of the pulling member 72. The first opening 713 is communicated with the second opening 715. A width of the first opening 713 is larger than the width of the second opening 715. The locking portion 710 comprises a pair of latching hooks 716 for locking with the mating connector. The pair of latching hooks 716 bend outwardly from opposite sides of a bottom of the locking portion 710.

The pulling member 72 is made of plastic materials and is substantially of a flat shape. The pulling member 72 comprises a round projection or transverse bar 720 on the front end of the pulling member 72, a horizontal portion 721 on the rear end of the pulling member 72, and a bending portion 722 connecting the round projection 720 and the horizontal portion 721. The pair of supports 126 support the bending portion 722 of the pulling member 72. The bending portion 722 comprises a top surface having a curved surface. A transition area 723 is formed between the round projection 720 and the bending portion 722. The transition area 723 is a cylinder whose radius is smaller than the width of the second opening 715.

The length of the round projection 720 is larger than the width of the second opening 715. The horizontal portion 721 is disposed on the upper wall 122 and extends out of the housing 1. The rear end of the horizontal portion 721 extending out of the housing 1 comprises some lines 725 to increase the friction force so that the pulling member 72 is easy to pull. In other embodiment, the rear of the horizontal portion 721 also defines an opening A tape going through the opening can be used to connect to the pulling member 72. The horizontal portion 721 comprises a limiting hole 724 to limit the driving range of the pulling member 72. The pair of latching hooks 716 are disposed against a bottom of the recessing groove 112 when the latch mechanism 7 is mounted on the housing 1. The two sides of the holding portion 711 are held in the slots 124. The round projection 720 of the pulling member 72 is disposed under the latch member 71. The bending portion 722 is disposed on the supports 126. When driving the pulling member 72, the locking portion 710 of the latch member 71 is supported by the holding portion 711 and rotated away from the mating portion 11.

Figure 2:
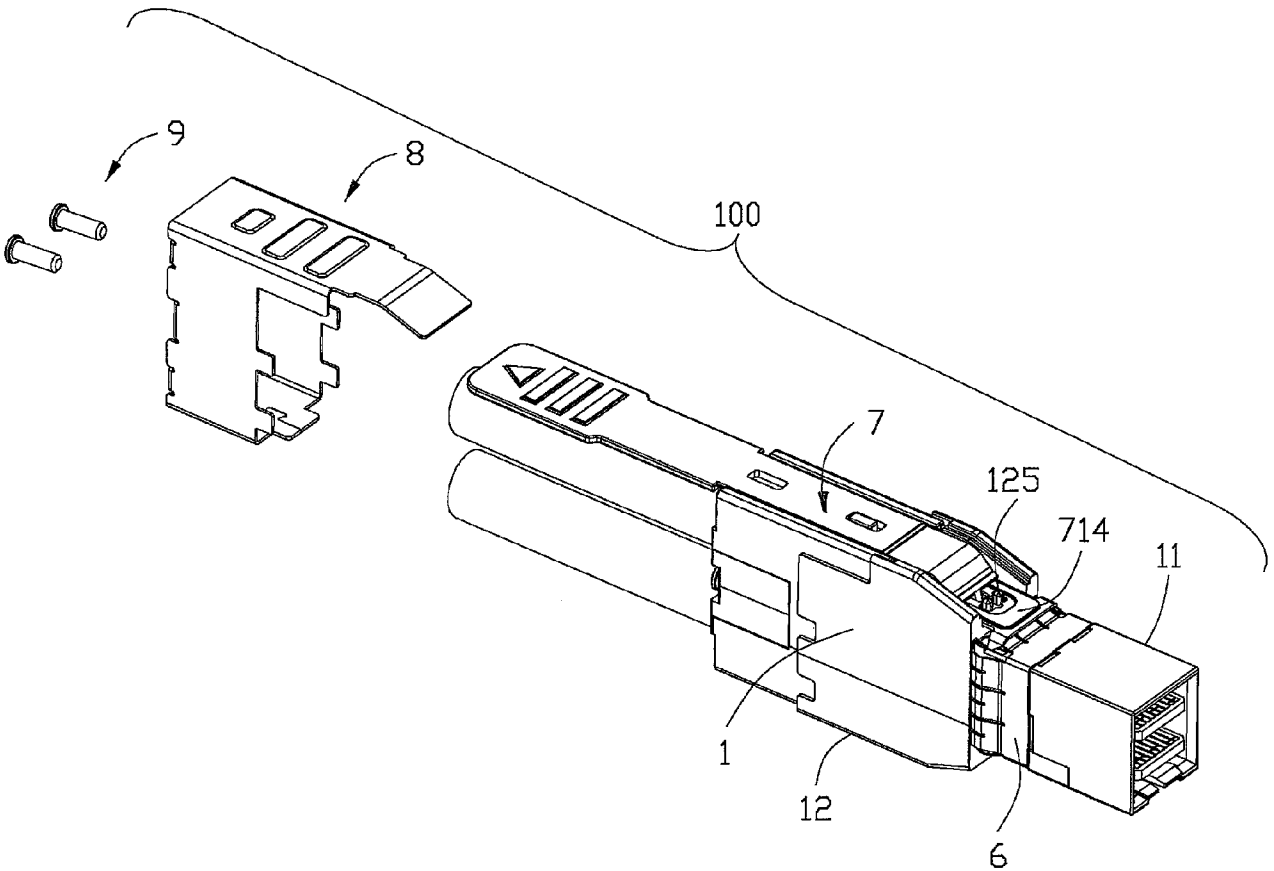
FIG. 2 is a partly exploded view of the connector assembly as shown in FIG. 1.
Figure 3:
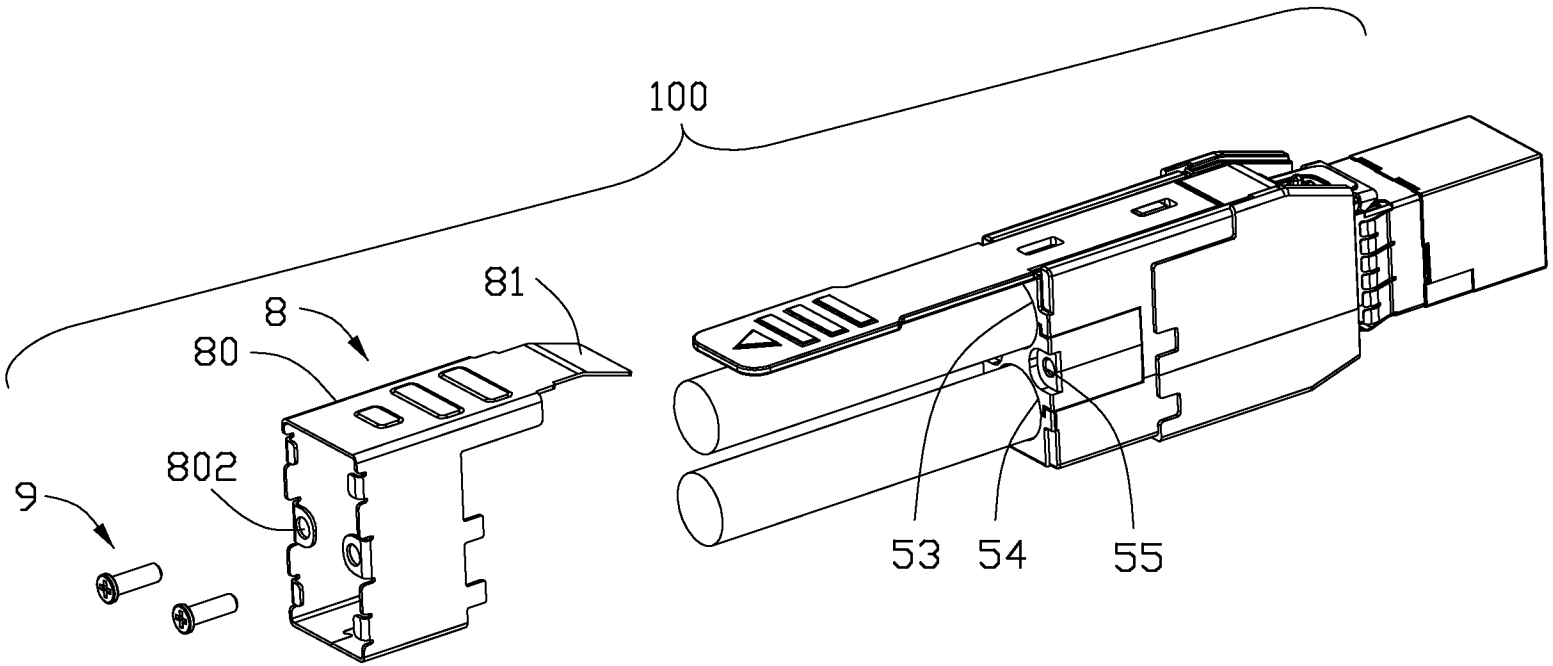
FIG. 3 is another partly exploded view of the connector assembly as shown in FIG. 1.

Referring to FIGS. 2 and 3, the metal casing 8 comprises a front portion 80 having a closed circumference and a shielding portion 81 extending forwardly from a top wall of the front portion 80. The size of the front portion 80 is suitable to be mounted around the housing 1 to unite the first housing 13 and the second housing 14 together. The two sides of the rear end of the front portion 80 comprise a plurality of stopping pieces extending vertically and inwardly respectively. Each of the two stopping pieces near the middle portion comprises a through hole. The shielding portion 81 is located above the receiving slot 123 when the metal casing 8 is disposed on the housing 1. The through holes 802 correspond to the mounting holes 55 of the carrier 5. A pair of mounting members 9 are inserted in the mounting holes 55 by extending through the through holes 802.

Referring to FIGS. 1 to 6, when assembly the connector assembly (not labeled), firstly, use the spacer 43 separating the core wires 41 of the cable 4 from each other. Each core wire 41 is soldered to the second portion 22 of the printed circuit boards 2 to establish the electrically connection. Since the number of the printed circuit board 2 in this embodiment is a pair, so the number of the combination of the cable 4 and the printed circuit board 2 is also a pair.

The stepped portion 23 is held in the retaining slots 132. The separator 3 is put on the printed circuit board 2 with the holder block 31 held in the retaining slots 132. Then the carrier 5 is mounted on the rear end of the first housing 13. The second housing 14 is assembled with the first housing 13. The EMI gasket 6 is set into the recessing area 111 from the mating portion 11 to fasten the housing 1.

The latch mechanism 7 is disposed on the surface of the first housing 13. The metal casing 8 is set around the first housing 13 and the second housing 14 from the rear end of the housing 1. The mounting members 9 fix the metal casing 8 and the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising a connector and a cable connected with the connector, the connector comprising:

a housing comprising a mating portion and a body portion, the body portion comprising a receiving slot at a front end thereof and a post projecting upwardly from a bottom wall of the receiving slot;

a latch mechanism mounted on the housing, the latch mechanism comprising a latch member received in the receiving slot and a pulling member coupled to the latch member and moveable along a horizontal direction, the latch member comprising a locking portion extending beyond the body portion and above the mating portion, a holding portion held on the body portion, and a connecting portion connecting the locking portion and the holding portion, the pulling member being actuatable to release the locking portion from a locking state, the connecting portion of the latch member comprising a first opening mating with the post, the first opening extending from a middle line of the mating portion sidewardly to both sides of the mating portion; and a metal casing enclosing the housing; wherein the connecting portion of the latch member comprises a second opening extending along a front-to-back direction; wherein the first opening is communicated with the second opening; wherein a width of the first opening is larger than the width of the second opening; and the connecting portion of the latch member comprises a projection extending along the two sides thereof beside the first and second openings.

2. The cable connector assembly as recited in claim 1, wherein the locking portion comprises a pair of latching hooks locking with the mating connector, the pair of latching hooks bent outwardly from opposite sides of a bottom of the locking portion.

3. The cable connector assembly as recited in claim 2, wherein the mating portion of the housing comprises a pair of recessing grooves, the pair of latching hooks disposed against a bottom of the recessing groove when the latch mechanism mounted on the housing.

4. The cable connector assembly as recited in claim 1, wherein the pulling member comprises a round projection on the front end of the pulling member, a horizontal portion on the rear end of the pulling member and a bending portion connecting the round projection and the horizontal portion, the receiving slot comprising a pair of supports supporting the bending portion of the pulling member.

5. The cable connector assembly as recited in claim 4, wherein the bending portion comprises a top surface having a curved surface.

6. The cable connector assembly as recited in claim 1, wherein the receiving slot comprises a pair of side walls extending upwardly from the bottom wall of the receiving slot and a back wall on the rear of the receiving slot, a pair of slots formed between the back wall and the pair of side walls, the slots being in communication with the receiving slot.

7. The cable connector assembly as recited in claim 1, wherein the metal casing comprises a front portion having a closed circumference and a shielding portion extending forwardly from a top wall of the front portion, the shielding portion located above the receiving slot.

8. A cable connector assembly comprising:

a housing defining a receiving slot in an exterior surface;

a latch mechanism assembled to the exterior surface of the housing and including a metallic deflectable latch member secured to the housing and in and out moveable with regard to the receiving slot in a cantilevered manner, and an insulative deflectable pulling member located behind and engaged with the latch member, the latch member defining a latching hook at a front end, a through hole and a U-shaped rib structure surrounding a front side and two opposite lateral sides of said through hole in a top view, and the pulling member forming at a front end a transverse bar extending through the through hole and under the latch member in an intersecting manner; wherein when the pulling member is move backwardly generally in a horizontal direction, the latch member is upwardly raised up in said cantilevered manner to have said latching hook move away from the exterior surface for unlatching.

9. The cable connector assembly as claimed in claim 8, wherein said through hole defines a T-shaped contour in the top view.

10. The cable connector assembly as claimed in claim 8, further including an immovable metallic casing to cover a front portion of the pulling member and a rear portion of the latch mechanism.

11. The cable connector assembly as claimed in claim 8, further including an upstanding post in the receiving slot and received within the through hole and located in front of the transverse bar so as to prevent withdrawal of the transverse bar from the through hole.

* * * * *